US006507324B2

(12) United States Patent
Overton et al.

(10) Patent No.: US 6,507,324 B2
(45) Date of Patent: Jan. 14, 2003

(54) ANTENNA QUICK CONNECT/DISCONNECT SYSTEM AND METHOD

(75) Inventors: Steven R. Overton, Seattle, WA (US); Ronald Darvie, Duvall, WA (US)

(73) Assignee: Harris Broadband Wireless Access, Inc., Bellevue, WA (US)

( * ) Notice: Subject to any disclaimer, the term of this patent is extended or adjusted under 35 U.S.C. 154(b) by 0 days.

(21) Appl. No.: 09/893,429

(22) Filed: Jun. 29, 2001

(65) Prior Publication Data

US 2002/0105475 A1 Aug. 8, 2002

Related U.S. Application Data

(60) Provisional application No. 60/266,485, filed on Feb. 6, 2001.

(51) Int. Cl.[7] ..... H01Q 19/12

(52) U.S. Cl. ..... 343/840; 343/916

(58) Field of Search ..... 343/839, 840, 343/786, 912, 915, 916, 772

(56) References Cited

U.S. PATENT DOCUMENTS

| | | | | |
|---|---|---|---|---|
| 4,527,167 A | * | 7/1985 | Miladinovic | 343/840 |
| 6,016,313 A | | 6/2000 | Foster, Jr. et al. | 370/330 |
| 6,340,956 B1 | * | 1/2002 | Bowen et al. | 343/840 |

* cited by examiner

*Primary Examiner*—Tan Ho
(74) *Attorney, Agent, or Firm*—Duane Morris LLP

(57) ABSTRACT

A method and apparatus for quickly connecting and disconnecting an antenna from a transceiver in a point-to-multipoint millimeter wave wireless communications system.

10 Claims, 2 Drawing Sheets

ANTENNA QUICK CONNECT/DISCONNECT SYSTEM AND METHOD

The present application claims the priority of pending U.S. Provisional Application Serial No. 60/266,485 filed Feb. 6, 2001 for "Antenna Provisional," the disclosure of which is hereby incorporated herein by reference. This application is related to commonly assigned U.S. patent application Ser. No. 09/863,010, entitled Spring Loaded Antenna Mounting System and Method; Ser. No. 09/893,013, entitled Geared Antennae Aiming System and Method; Ser. No. 09/893,007, entitled Antenna Quick Connect/Disconnect System and Method; and Ser. No. 09/893,440, entitled Hub IDU Insert Panel and Method, the disclosures of which are hereby incorporated by reference.

BACKGROUND

The present invention relates generally to antennae mounting systems and methods for millimeter wave point-to multipoint wireless communications systems.

Point-to-multipoint millimeter wave wireless communications systems are well known and are described, for example, in the commonly assigned U.S. Pat. No. 6,016,313, entitled "System and Method for Broadband Millimeter Wave Data Communication." Such systems generally consist of one or more hubs servicing a plurality of remote nodes. At both the hub and node sites, antennae must be mounted onto brackets which provide support for the antenna during system operation.

Point-to-multipoint communication systems are generally modular, and generally the system must be reconfigured from time to time during operation. This configuration may include antennae of various sizes and shapes to effect the shape of the beam emitted therefrom. The need to change the reflector of such an antenna may arise because, e.g., the reflector has in some way been damaged, or the shape of the reflector must be changed to match a characteristic of the communication signal emanating from that particular antenna, or it becomes desirable to reshape the antenna beam as the result of changes in the number and location of subscribers to the communication system. In addition, it is often desirable to test the transceiver without the presence of the antenna.

Generally, the antenna is built as an integral structure with the reflector bolted or otherwise permanently or semi-permanently attached to the supporting structure which may include a waveguide and the means to mount the antenna on appropriate supporting structure.

Physically removing and/or installing an antenna is often a time intensive and manpower intensive job, particularly where the antenna is positioned at elevations where the workers are exposed to potentially dangerous wind and weather conditions. The weight and sail area of the antenna often present a handling problem, particularly where the application of considerable force is required. Several persons may be required to perform different tasks simultaneously, e..g., the antenna must be supported while mechanical fasteners are manipulated. This problem may be compounded where an attempt is made to remove only the reflector, and reflectors are often destroyed by the act of removing them requiring the replacement of the entire antenna.

Accordingly, it is an object of the present invention to provide a novel antenna and method in which the reflector may easily and safely removed from the remainder of the antenna before, during or after installation of the antenna.

It is another object of the present invention to provide a novel antenna and method in which the reflector may replaced with the aid of mechanical assistance, and leaving the connection of the antenna waveguide to a support bracket undisturbed.

DETAILED DESCRIPTION OF PREFERRED EMBODIMENTS

Figure 1:
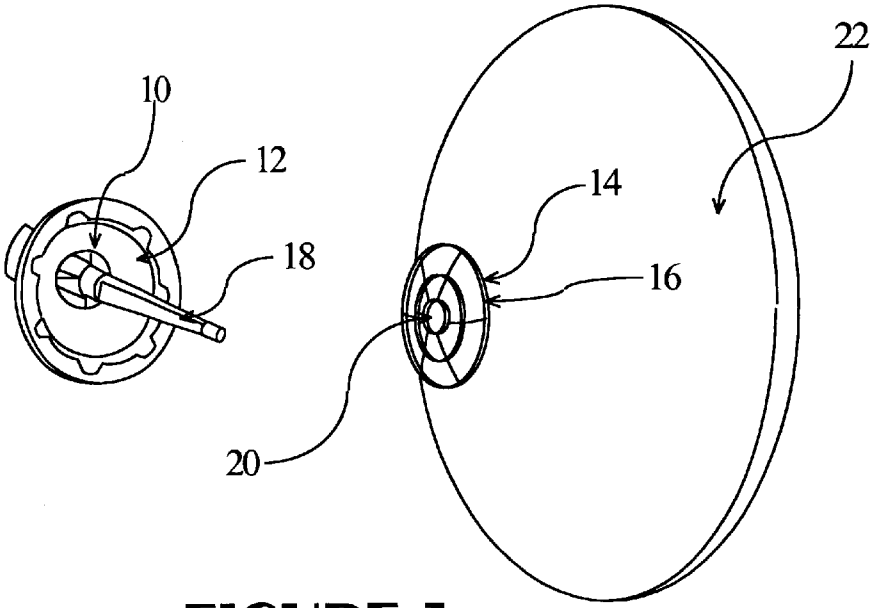
FIG. 1 is an exploded view of one embodiment of the antenna of the present invention.
Figure 2:
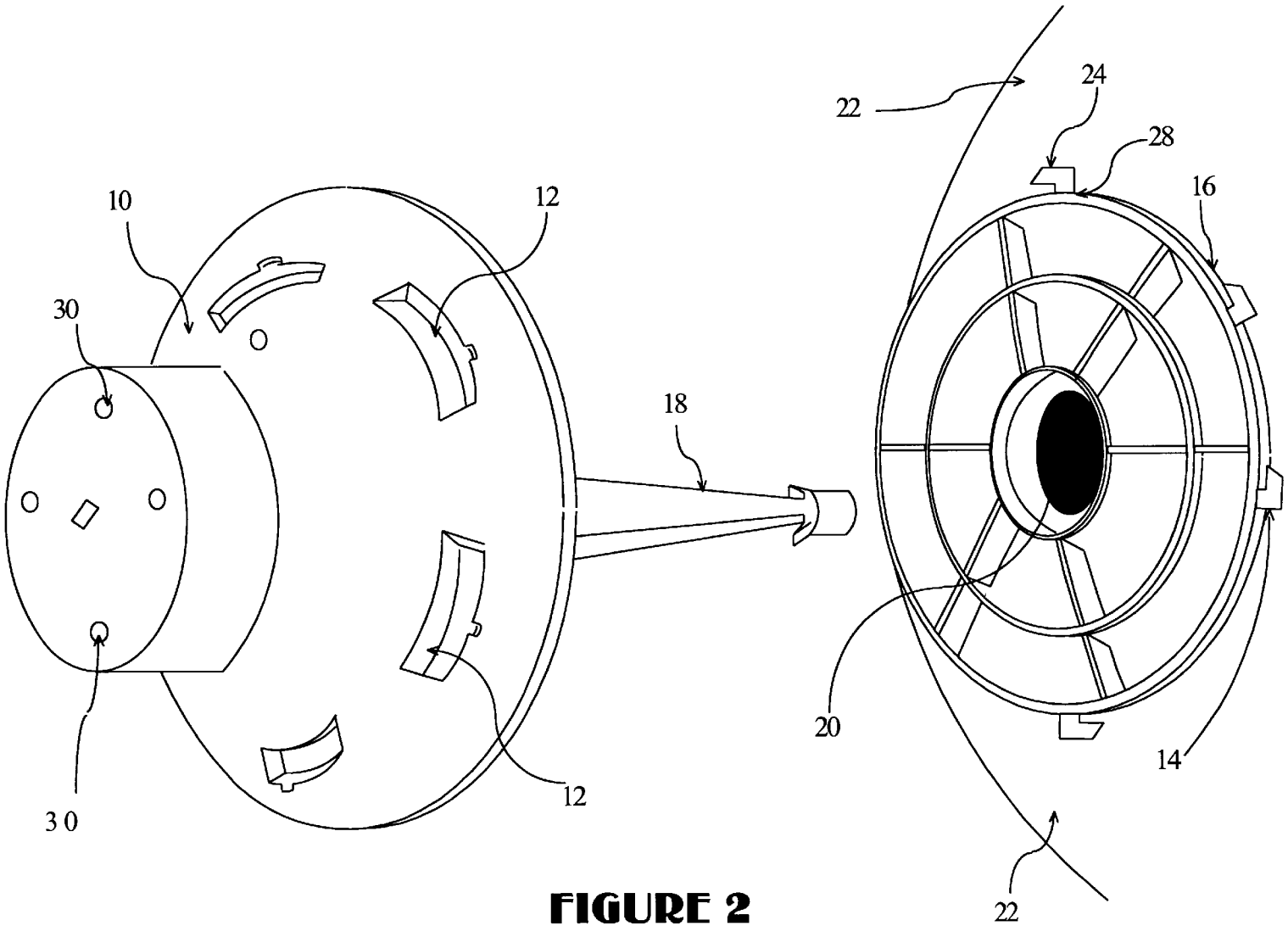
FIG. 2 is an exploded pictorial view illustrating the connection of the antenna components of FIG. 1 in greater detail.

With reference to FIGS. 1 and 2 where like elements have been accorded like numerical designations, the antenna comprises a base 10 and reflector 22. As shown more clearly in FIG. 2, the base may be provided with apertures 30 for the attachment of the base 10 to a suitable conventional support bracket (not shown for clarity). The base 10 includes a waveguide 18 extending through the base 10 and standing proud therefrom for the emmination of electromagnetic energy therefrom from an attached or remote source (not shown).

As shown in FIG. 2, the base 10 may include a series of female connectors 12 spaced equally around the waveguide 18. As illustrated in greater detail in FIG. 3, these female connectors 12 in the preferred embodiment take the form of arcuate slots and are desirably provided with an internal spring biased latch 24.

The reflector 22, a parabolic dish reflector in the embodiment shown, is provided with a central aperture 20 through which the waveguide 18 may be inserted as the reflector is positioned with respect to the base 10.

The reflector 22 is also provided with a connecting ring 16 provide with male connectors 14 adapted to mate with the female connectors 12 of the base 10. Each of the connectors 14 may include a lower section 28, connected to the connecting ring 16, and an upper section 26 and lying generally orthogonal to the lower section 28.

Figure 3:
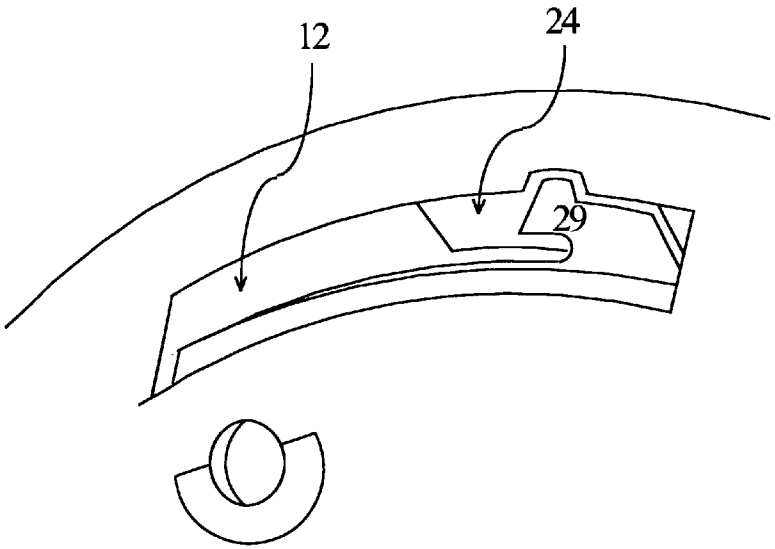
FIG. 3 is a pictorial close up of one embodiment of the latch inside the slots of the antenna base shown in FIGS. 1 and 2.

Referring to FIG. 3, each of the slots 12 may be internally configured to include a sprig biased latch 24 so that the rotation of the reflector 22 with the male connectors 14 inserted within the female connectors 12, the top section 26 of the connector passes through the gap 29 in the latch 24 to removably latch the parabolic dish reflector 22 to the base 10.

To remove the reflector 22 from the base 10, the process is reversed. That is, the reflector 22 may be rotated about the axis defined by the waveguide 18 in the opposite direction, here clockwise, until the top section of the connector 26 is fully disengaged from the latch 24 and the reflector may be withdrawn form the base.

As is readily apparent, the reflector 22 may be removed from the antenna leaving the base attached to the antenna supporting structure. This capability has great utility in the testing of the antenna and/or the transceiver to which it may be directly attached. In addition, the separation of the antenna from the base, and the base from the transceiver, greatly facilitates installation because of the reduction in the weight which must be handled. Moreover, the reflector may be easily removed and replaced without disturbing the installation of the base, the connection to the antenna waveguide or the alignment of the antenna which is often critical in millimeter wave communication systems.

While preferred embodiments of the present invention have been described in the foregoing, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A parabolic dish antenna with a quick connect/disconnect between the parabolic dish and the antenna waveguide, comprising:

a base configured for removable attachment to a transceiver and having an elongated antenna waveguide standing proud therefrom, said base having a plurality of arcuate spaced apart slots radially spaced from the proximate end of the waveguide; and a parabolic dish having a central aperture for receiving the distal end of said waveguide therethrough and having a connecting ring on the proximate side thereof, said connecting ring having a plurality of spaced apart connector elements each configured for insertion into one of said plurality of slots and for retention therein when inserted and rotated about said waveguide, so that said parabolic dish is capable of being manually and removably attached to said base without removing said base from any transceiver to which attached.

2. The antenna of claim 1, wherein the number of said slots and connector elements is not less than three.

3. The antenna of claim 1, wherein said base is substantially cylindrical in shape.

4. The antenna of claim 1, where said base includes a latch within each of said slots to detachably mate with one of said spaced apart connector elements.

5. A method of detachably attaching a parabolic dish to the distal side of the base of a waveguide so that the parabolic dish is capable of being attached and removed without disturbing the connection at the proximate side of the waveguide, comprising:

(a) providing the waveguide base adapted for connection on the proximate side thereof to a source of electromagnetic energy, having a waveguide protruding from the distal side thereof, and having a plurality of slots radially spaced about the waveguide and substantially evenly spaced from each other, each of the slots having an internal latch;

(b) providing the parabolic antenna dish having a central aperture for receiving the waveguide of the base therethrough and having plural spaced apart connectors radially spaced radially from the aperture and protruding from the proximate side thereof;

(c) positioning the antenna dish in an overlying position relative to the base with the waveguide extending through the aperture in the dish and with the connectors on the proximate side thereof inserted within the slots;

(d) manually rotating the antenna dish to latch the connectors to the slots of the base so that the parabolic dish is capable of being attached and removed without disturbing the connection at the proximate side of the waveguide to a source of electromagnetic radiation.

6. The method of claim 5 wherein the rotation of the antennas dish required to effect a latch of the connectors within the slots is less than about 45°.

7. The method of claim 5 wherein the rotation of the antennas dish required to effect a latch of the connectors within the slots is about 30°.

8. In a point-to-multipoint millimeter wave communication system, a directional antenna comprising:

a base configured at the near end for attachment to a supporting structure and having a waveguide standing erect from the far end thereof, said base having a plurality of spaced apart female connectors substantially equal distance from said waveguide; and a reflector apertured to permit said waveguide to protrude therethrough when the near side of said reflector is positioned adjacent the far side of said base, said reflector having a plurality of spaced apart male connectors substantially equal distance from the aperture therein on the near side thereof in position for insertion into said female connectors.

9. A method of mounting a directional antenna in a point-to-multipoint millimeter wave communication system comprising the steps of:

(a) attaching a waveguide supporting base including a waveguide protruding therefrom to an antenna supporting structure;

(b) removably attaching a parabolic dish reflector including an aperture for receiving the waveguide to the base with a quick connect/disconnect latch.

10. A method of removably replacing the reflector of a directional antenna in a point-to-multipoint millimeter wave communication system comprising the steps of:

(a) providing a directional antenna having a base including a waveguide protruding therefrom attached to antenna supporting structure, and a first parabolic dish reflector including an aperture for receiving the waveguide;

(a) removably detaching the first reflector from the base with a quick connect/disconnect latch;

(b) removably attaching a second parabolic dish reflector including an aperture for receiving the waveguide to the base with a quick connect/disconnect latch.

* * * * *